United States Patent [19]

Cheng

[11] 4,084,746

[45] Apr. 18, 1978

[54] MODEL TRACK SECTION

[76] Inventor: Richard C. M. Cheng, 1007 Crestmont Ave., Mantua, N.J. 08051

[21] Appl. No.: 717,581

[22] Filed: Aug. 25, 1976

[51] Int. Cl.[2] ..... A63H 19/30

[52] U.S. Cl. ..... 238/10 F; 46/1 K; 104/147 A

[58] Field of Search ..... 238/10 R, 10 A, 10 B, 238/10 C, 10 E, 10 F; 104/53, 60, 147 A, 149; 46/1 K, 216; 339/252 R, 252 P; 191/22 C

[56] References Cited

U.S. PATENT DOCUMENTS

| | | | |
|---|---|---|---|
| 217,755 | 7/1879 | Turl | 238/10 R |
| 1,358,924 | 11/1920 | Bartlett | 238/10 R |
| 3,140,825 | 7/1964 | Edmondson | 238/10 F |
| 3,206,122 | 9/1965 | Frisbie et al. | 238/10 F |
| 3,602,430 | 8/1971 | Fischer | 238/10 E |
| 3,950,070 | 4/1976 | Groft et al. | 339/252 P |

*Primary Examiner*—Drayton E. Hoffman
*Assistant Examiner*—Randolph A. Reese
*Attorney, Agent, or Firm*—Robert K. Youtie

[57] ABSTRACT

A model track section for model vehicles releasably interengageable in end-to-end connection with a like track section, wherein an end formation is provided having one side facing generally laterally, and resilient means is located obliquely along the laterally facing side for resilient deflection laterally toward the formation upon end-to-end interengagement of like track sections.

5 Claims, 4 Drawing Figures

FIG. 1
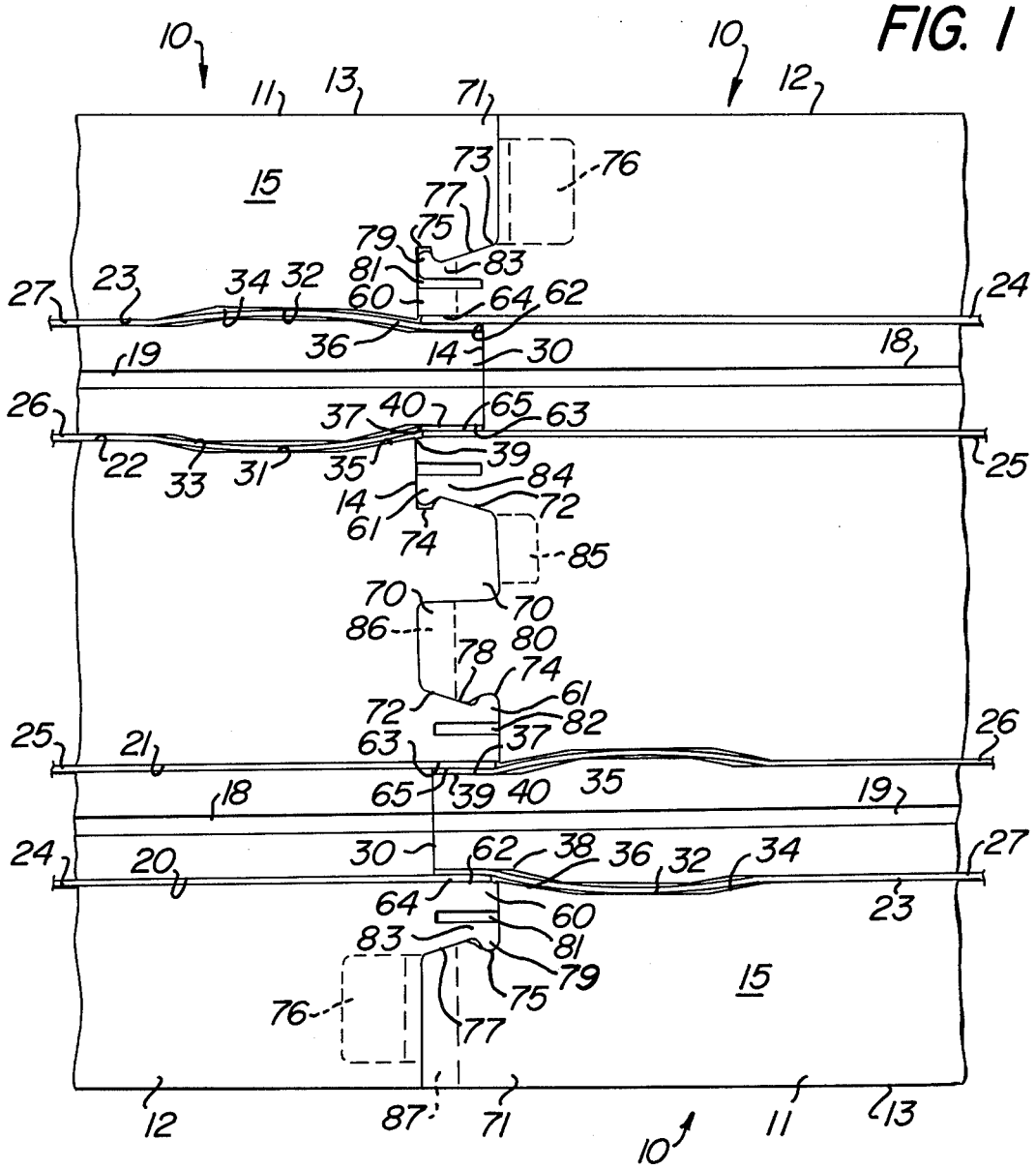
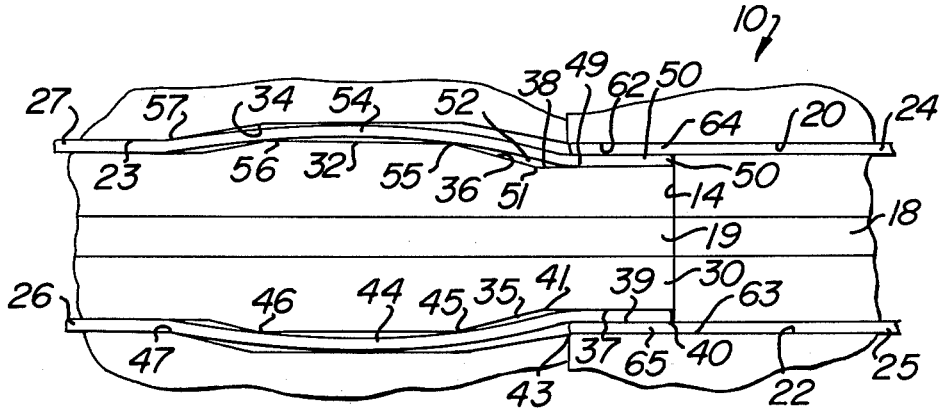
FIG. 2

FIG. 3
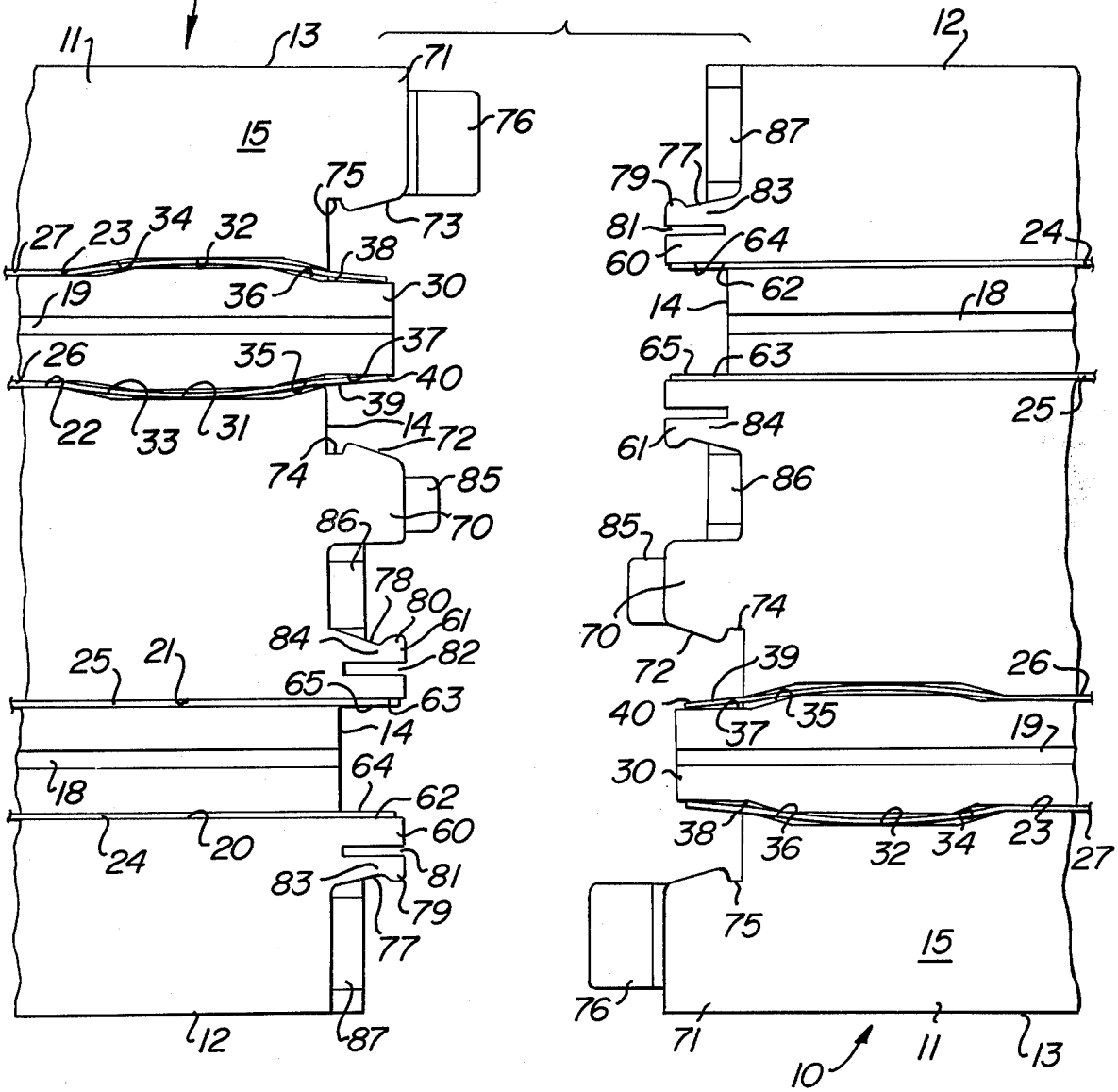
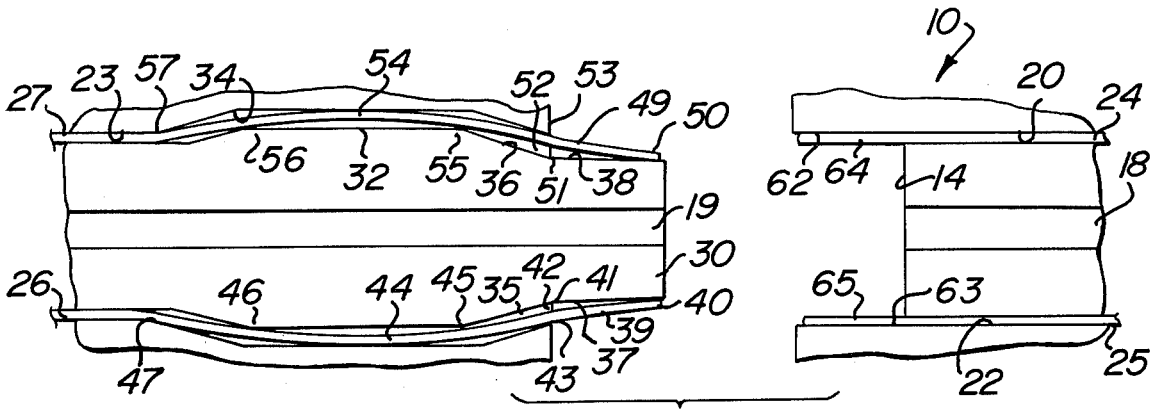
FIG. 4

MODEL TRACK SECTION

BACKGROUND OF THE INVENTION

Prior model track constructions have required an inordinate degree of dexterity and strength to connect and disconnect, while being subject to breakage, faulty electrical contact and unintended looseness or disconnection upon usual conditions of use which may often be severe and abusive. Also, certain prior track constructions involved a particular angulate relative movement for connection and disconnection, and required excessive materials, to increase difficulty of use and cost of manufacture.

SUMMARY OF THE INVENTION

It is, therefore, an important object of the present invention to provide a model track construction which overcomes the above-mentioned difficulties, is uniquely simple in operation required to effect track section connection and disconnection, being merely longitudinal coplanar movement toward and away from each other, as by sliding on a flat surface and wherein the force required is considerably reduced so as to permit of easy usage even by children of young age.

It is still a further object of the present invention to provide a track section having the advantageous characteristics mentioned in the preceding paragraph wherein a unique conductor wiping action is achieved to effectively insure superior electrical contact between track sections.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top plan view showing a pair of track sections of the present invention in end-to-end assembled relation, the nonadjacent ends being broken away to facilitate enlargement and clarity.

FIG. 2 is an enlarged fragmentary plan view similar to FIG. 1, showing the structural features of the instant invention in greater detail.

FIG. 3 is a top plan view of the disconnected track sections of FIG. 1.

FIG. 4 is a partial top plan view showing the disconnected portions of FIG. 2.

DESCRIPTION OF THE PREFERRED EMBODIMENT

Referring now more particularly to the drawings, and specifically to FIGS. 1 and 3 thereof, a pair of substantially identical model track sections are each there generally designated 10, each track section having its opposite ends identical, so that only a single end need be shown and described.

Each track section 10 may include a generally elongate substantially flat bed or body 11 which may have along opposite side edges a pair of longitudinally extending sides or walls 12 and 13, and along each end extending laterally thereacross an end wall 14. The underside may be of any suitable construction, say hollow with strengthening ribs, as desired, and is not shown as not essential to understanding of the invention. The upper, generally flat surface 15 of body 11 provides a supporting surface for a vehicle moving along the body. The body 11 may be formed with a pair of generally parallel, longitudinally extending guiding formations or grooves 18 and 19 facing upwardly for slidably receiving the depending guide member of a moving vehicle, which guideways or grooves open longitudinally outwardly through opposite ends of the body 11. Also formed in the upper model vehicle supporting surface 15, on opposite sides of the guideways or grooves 18 and 19 are upwardly opening grooves or recesses receiving fixed rails or strips of conductive material. More particularly, a pair of generally parallel, longitudinally extending open ended grooves 20 and 21 are formed in the body 15, respectively on opposite sides of the guideway 18 and opening through opposite ends of the body. On opposite sides of the guideway or groove 19, there are similarly provided a pair of upwardly opening, longitudinally extending, open ended rail receiving recesses or grooves 22 and 23. A pair of elongate conductive metal strips, say of suitably resilient material, are respectively engaged in grooves 20 and 21, as at 24 and 25, the strips being suitably secured in position, as by staking, or the like. Similarly secured in position in respective grooves 22 and 23 are resilient, conductive metal strips 26 and 27.

The body 11 is provided with a longitudinal end extension or projection 30, which may include an extension of groove 19 and adjacent body material located generally between grooves 22 and 23. Further, the strip receiving grooves 22 and 23 include, adjacent to the body formation or extension 30, a pair of laterally outwardly offset groove portions 31 and 32, and oblique connection portions 33 and 34. That is, the connection portion 33 extends obliquely laterally outwardly from the main portion of groove 22 to its laterally outwardly offset portion 31, and similarly the oblique connecting groove portion 34 extends from the main portion of its groove 23 to the outwardly offset portion 32. The outwardly offset groove portions 31 and 32 terminate short of the body end 14 and formation 30, and extend toward the same by oblique, laterally inwardly extending portions 35 and 36. That is, the laterally outwardly offset groove portion 31 extends laterally inwardly through oblique groove portion 35 toward and terminates proximate to the end wall 14, while laterally outwardly offset groove portion 32 extends laterally obliquely inwardly and terminates adjacent to body end 14, as by groove portion 36. The oblique groove portions 35 and 36 thus terminate in open ends opening generally through body end 14 proximate to and on opposite sides of the extending formation 30. The extending formation 30 has its opposite sides 37 and 38 as respective extensions of the inner sides of grooves 35 and 36, being disposed at an obtuse angle with respect thereto. The opposite sides 37 and 38 of extending formation 30 may be generally parallel and, as the body end 14 and groove portions 35 and 36 terminate just short of the formation 30, the opposite sides thereof face laterally outwardly in opposite directions toward unoccupied spaces, in the disconnected condition.

The groove portions 33, 31 and 35 of groove 22 may be slightly wider than the thickness of strip 26, so that the strip may be readily curved or bent and inserted into the groove portions without permanent deformation or distortion of the strip. Further, the end portion 39 of strip 26 extends through the oblique groove portion 35 outward beyond the open end thereof and along formation side 37 to terminate at a free end 40 proximate to the formation side 37. As appears in the drawings, the side wall or surface 37 of formation 30 is disposed generally longitudinally of the body 11, being parallel to the longitudinal axis thereof, and merges at a juncture 41, see FIG. 4, with the inner wall of groove portion 35 at an obtuse angle of less the 180°. This internal angle at the juncture 41 defines a concavity 42 generally on the side of and facing laterally outwardly from the formation 30. The end portion 39 of strip 26 extends obliquely across the concavity 42, and may be considered as extending obliquely inwardly from its outer end 40 at the side 37 of formation 30 toward and into the groove portion 35 of body 11. The outer side of groove portion 35 terminates in an end or bearing region 43 generally opposite to the concavity 42 and juncture 41, and is in bearing engagement with the resilient strip portion 39 to maintain the strip end 40 against the formation side 37 and hold the strip portion in its oblique disposition extending across the concavity 42. From the strip end portion 39, the strip extends inwardly and arcuately, as at strip portion 44 located in laterally outwardly offset groove portion 31, being in bearing engagement with external juncture point 45 of angulate groove portions 35 and 31, and in bearing engagement with external juncture point 46 of angulate groove portions 31 and 32. Also, the strip 26 may be in bearing engagement with external juncture point 47 of groove portion 33 and the adjacent longitudinal portion of groove 22.

It will now be appreciated that the obliquely disposed strip end portion 35 may be considered as a resilient leaf spring, being resiliently deflectable laterally inwardly toward the concavity 42, the strip end region 40 being free to slide on formation side 37. Also, it will be observed that the formation side 37 is located laterally closer to the guideway or groove 19 than the strip receiving groove 22, so that the strip end portion 40 is located closer to the guideway or groove 19 than the main portion 26 of the conductive strip.

The conductive strip 27 is similarly arcuately bent within its elastic limit to extend obliquely laterally away from the guideway or groove 19 in the groove portion 34, thence along the laterally outwardly offset groove portion 32, and thence obliquely laterally inwardly along groove portion 36. The end portion 49 of strip 27 extends outwardly through and beyond the oblique groove portion 36 generally along the longitudinal side surface 38 of formation 30 to a free terminal end region 50. The formation side or surface 38 is generally longitudinal, being parallel to the longitudinal axis of the body 11 and terminates at a juncture 51 with the inner side of groove portion 36 defining an obtuse internal angle or concavity 52. The groove portions 36, 32 and 34 may be somewhat wider than the thickness of strip 27 for easy extension of the strip through the several grooves, permitting of smooth strip curvature without deformative bending. Opposite to the internal angle or concavity 52, the groove portion 36 terminates in a generally acute angular formation or bearing point 53, which is in bearing engagement with the laterally outer side of strip end portion 49 in the disconnected conditions shown in FIGS. 3 and 4, to hold the strip end portion in its oblique position extending across the concavity 52 and maintain the strip terminus 50 in engagement with the formation side surface 38. Through the laterally outwardly offset groove portion 32, the received strip portion 54 is smoothly arcuate, and may be in bearing engagement with the external juncture or bearing point 55 at the juncture of strip portions 36 and 32, and may also be in engagement with external bearing point 56 at the juncture of groove portions 32 and 34. On the laterally outer side of the strip 27, in bearing engagement therewith may be a bearing point 57 at the juncture of groove portion 34 and the major longitudinal portion of groove 23.

As described in connection with the strip 26, the strip 27 may also have its end region 50 engaging formation side 38 along a line offset inwardly toward guideway 19 relative to the major portion of groove 23 and strip 27.

In the illustrated embodiment the extending formation 30 and its associated, obliquely disposed resilient means or strip end portions 39 and 49 may be considered a male formation, and the opposite end of resilient metal strips 26 and 27 at the opposite end of body 11 may be provided with a female formation for detachable connection with like track sections in male-to-female end engagement. Of course, each track end region may be provided with both male and female formations, as illustrated herein, thus being hermaphroditic for detachable end-to-end connection with either end of a like track section.

Such an arrangement is shown in the drawings, wherein the guideway or groove 18 terminates at body end 14, the body end being provided with a pair of end extensions 60 and 61 spaced on opposite sides of the guide groove 18, being respectively outward of and flush with the outer side of strip receiving grooves 20 and 21. That is, the inner side of extension 60, as at 62, may be a generally flush extension of the outer side of groove 20, while the inner side 63 of extension 61 may be a flush extension of the outer side of groove 21. The respective conductive metal strips 24 and 25 extend beyond their respective grooves 20 and 21, terminating in end portions 64 and 65 respectively located along facing extension sides 62 and 63. Thus, the strip end extension 64 and 65 are generally parallel to each other and the longitudinal axis of body 11, being in laterally spaced facing relation with respect to each other, and are spaced apart a distance slightly greater than the spacing of strip ends 40 and 50, for a purpose appearing presently.

The combinative relationship of the extending portions 60 and 61 extending beyond the intermediate body region, and the extending end portions 64 and 65 of strips 24 and 25 also extending beyond the intermediate body region may serve as a female formation for interengagement with a male formation, as described hereinbefore, of another like track section.

Spaced on opposite sides of the formation 30 and its oblique resilient strip portions or leaves 38 and 39 are a pair of end extensions 70 and 71, each having an oblique inner edge, as at 72 and 73, respectively, adjacent to and converging inwardly toward the formation 30. The generally convergent oblique surfaces 72 and 73 terminate in undercuts 74 and 75, respectively, adjacent to the body end 14. A lug 76 projects generally longitudinally outwardly from the outer end of extension 71. The extensions 60 and 61 are provided on their outer sides remote from the strip end portions 64 and 65 with longitudinally outwardly convergent sides 77 and 78, respectively, terminating at their outer ends in lateral protuberances 79 and 80. The extensions 60 and 61 are each split or bifurcated, as by cuts 81 and 82, which serve to define of the laterally outer portions 83 and 84 resiliently laterally deflectable fingers, for a purpose appearing presently.

The projection 70 may also be provided with a longitudinally outstanding lug 85, while the body end wall may be provided, as at 86 and 87 with lug receiving formations for receiving respective lugs 85 and 76 of a like track section.

As best seen by comparison of FIGS. 3 and 1, the like track sections have substantially identical ends and are movable along their aligned longitudinal axes into and out of interfitting engagement. The lugs 76 and 85 will engage in the lug receiving formations 87 and 86, respectively. The formation 30 and adjacent resilient leaves 39 and 49 enter between the extending portions 60 and 61 of the other track section, which extending portions enter between the formation 30 and projections 71 and 70. More specifically, the lateral protrusions 79 and 80 of the extensions 60 and 61 ride on inclined sides 73 and 72, being deflected thereby and snap into respective undercuts 75 and 74. Simultaneously, longitudinal strip end portions 64 and 65 will rub along and laterally inwardly deflect strip end portions 49 and 39 toward their respective adjacent concavities 52 and 42. This rubbing action between strip end portions and resilient deflection insures clean effective electrical contact therebetween. Disconnection of the track sections is effected by mere longitudinal separation to withdraw the parts which assume their original configuration.

From the foregoing it will now be understood that the track section of the present invention is extremely simple in construction and operation, capable of economic manufacture, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A track section for model vehicles comprising an elongate body, vehicle support means extending longitudinally on said body, a formation on each end of said body having one side facing generally laterally and provided with a generally laterally facing concavity, resilient means on said one side of each of said formations extending obliquely therefrom toward said body across the concavity of said formation and being deflectable laterally toward the concavity of the associated formation, interengagement means on each end of said body configured to cooperate with said formation for removable interengagement in end-to-end relation with a like track section with said resilient means deflected laterally toward the adjacent concavity, said resilient means comprising an obliquely disposed conductive metal strip portion, said interengagement means and formations being configured to guide a like track section longitudinally into and out of said end-to-end relation at an angle with respect to said metal strip portions for laterally deflecting the latter toward said concavities, and an additional conductive metal strip portion extending inwardly from said oblique metal strip portion longitudinally along said body and having its opposite end portion exposed laterally for bearing engagement with an oblique metal strip portion of a like track section, said obliquely disposed metal strip portion and said additional conductive metal strip portion being an integral length of resiliently deflectable strip material substantially straight in its undeflected condition.

2. A track section according to claim 1, said formations each having its other side facing oppositely laterally, and additional resilient means on the other side of each formation extending obliquely toward said body and being deflectable laterally toward the associated formation, said interengagement means including laterally spaced facing portions respectively engageable with said first-mentioned and additional resilient means of a like track section to laterally deflect both resilient means upon longitudinal end-to-end interengagement of track sections.

3. A track section according to claim 1, in combination with a bearing portion on said body adjacent to and spaced from each of said one formation sides and in bearing engagement with the adjacent resilient strip portion to hold the latter in position across the associated concavity.

4. A track section according to claim 1, in combination with an additional pair of conductive resilient metal strip portions each extending longitudinally along said body from the inner end of a respective first mentioned resilient strip portion the distal end portion of each of said additional strip portions being exposed laterally on the side toward each other for bearing engagement with said first mentioned strip portions of a like track section, and additional formations on each end of said body in resilient backing engagement with said distal end strip portions on the sides away from each other.

5. A track section according to claim 4, said first mentioned and additional formations extending longitudinally of said body beyond said first mentioned and additional strip portions to effectively protect the latter.

* * * * *